US005310193A

United States Patent [19]

Lowrance

[11] Patent Number: 5,310,193

[45] Date of Patent: May 10, 1994

[54] FEATURE FOR STARTING AND STOPPING OF GAME

[75] Inventor: Arlen J. Lowrance, Tulsa, Okla.

[73] Assignee: Carl J. Lowrance, Tulsa, Okla.

[21] Appl. No.: 913,399

[22] Filed: Jul. 15, 1992

[51] Int. Cl.[5] ..... A63F 9/00; F41J 1/10

[52] U.S. Cl. ..... 273/393

[58] Field of Search ..... 273/445, 446, 385, 393

[56] References Cited

U.S. PATENT DOCUMENTS

| | | | |
|---|---|---|---|
| 631,720 | 8/1899 | Jeffers | 273/390 |
| 1,098,255 | 5/1914 | Harper | 273/392 |
| 1,348,442 | 8/1920 | Prebble | 273/390 |
| 1,536,436 | 5/1925 | Kolinski | 273/393 |
| 1,993,949 | 3/1935 | Welser | 161/18 |
| 3,065,963 | 11/1962 | Dean | 273/1 |
| 3,558,132 | 1/1971 | Miller | 273/1 |
| 4,789,155 | 12/1988 | Barra | 273/1 |
| 5,018,117 | 5/1991 | Lowrance | 368/10 |
| 5,068,837 | 11/1991 | Lowrance | 368/10 |
| 5,094,461 | 3/1992 | Lowrence | 273/393 X |
| 5,180,170 | 1/1993 | Lowrence | 273/393 X |

*Primary Examiner*—William H. Grieb
*Attorney, Agent, or Firm*—William S. Dorman

[57] ABSTRACT

A feature for starting, stopping and recording playing time for a timed game, such as a pop target game, and provided with a momentary switch which connects electrically to a motor and to a stop watch. Toggling the momentary switch simultaneously starts the stop watch and activates the motor. Activation of the motor winds a cable around the motor shaft causing the cable to be withdrawn from a bar which holds the bar and an attached "start target" onto a horizontal rod of the game, thus causing the "start target" to fall. Falling of the "start target" signals a contestant to begin play.

Play ends when the contestant knocks a final "stop target" off a micro switch on which the "stop target" attaches to the game. Removal of the "stop target" opens the micro switch which, in turn, stops the stop watch by means of an electrical connection between the micro switch and the stop watch. The stop watch indicates the contestant's playing time which can be matched against playing times of other contestants.

2 Claims, 5 Drawing Sheets

FEATURE FOR STARTING AND STOPPING OF GAME

BACKGROUND OF THE INVENTION

1. Field of the Invention

The present invention is a feature for starting, stopping and recording playing time of a timed game, such as a pop target game. Contestants play by competing against their opponent's best time for completing the game.

2. The Prior Art

Timed games customarily have one contestant competing against the best playing time of another contestant rather than having the two contestants playing simultaneously. The game is normally started by a timekeeper yelling "go" and simultaneously punching a knob on a stop watch to start the stop watch. The game is normally ended when the timekeeper observes some event, such as the contestant completing the game, and then punches the knob on the stop watch a second time to stop the stop watch. One problem with this type of timekeeping is that manual starting and stopping of the stop watch by a time keeper is inherently subject to substantial errors due to the variation in the reaction times of an individual timekeeper or between different timekeepers.

It is the principle object of the present invention to automatically start and stop a stop watch in order to time a contestant's elapsed game time, thus allowing a contestant's elapsed game time to be recorded in a more accurate fashion than possible with manual starting and stopping of a stop watch. A further object is to provide a feature which can be activated either by the contestant or by another person.

3. Cross-Reference to Related Applications

This application constitutes an improvement over patent application Ser. No. 07/745,545 filed on Aug. 15, 1991 for a "Microswitch Activating Device For Fishing Game Apparatus", now U.S. Pat. No. 5,180,170, issued Jan. 19, 1993 by the inventor of the present invention and an improvement over patent application Ser. No. 07/835,367 filed on Feb. 14, 1992 for a "Fastener For Holding An Object Against The Side Of A Pipe" by the inventor of the present invention.

SUMMARY OF THE INVENTION

The present invention is a feature for starting, stopping, and recording playing time for a timed game, such as a pop target game.

One embodiment of the feature is provided with a momentary switch which connects electrically to a motor and also connects electrically to a stop watch. Toggling the momentary switch simultaneously starts the stop watch and activates the motor. Activation of the motor winds a cable around the motor's shaft causing the cable to be withdrawn from a notch in a bar extending upward through a hole provided in a horizontal rod of the game and, thus, allowing the bar and a "start target" which is attached to the bar to fall from the game. Falling of the "start target" signals a contestant to begin play.

Play ends when a contestant knocks a final "stop target" off a micro switch by which the "stop target" attaches to the game. Removal of the "stop target" opens the micro switch, thus stopping the stop watch to which the micro switch is electrically connected. The stop watch indicates the contestant's playing time which can be matched against playing times of other contestants.

Alternately, another embodiment of the present invention is provided with an alternate momentary switch which connects electrically to a stop watch. Toggling of the momentary switch starts the stop watch. The momentary switch is toggled by means of an eccentric cam which is attached to a pivotal arm on which an alternate "start target" mounts. When the alternate "start target" is struck by the contestant, the alternate "start target" and arm pivot, causing the attached eccentric cam to toggle the alternate momentary switch, thus starting the stop watch and starting the game. Play ends for this embodiment the same as previously described for the other embodiment.

A modification of the second embodiment allows the alternate "start target" to both start and stop the stop watch, thus eliminating the need for the "stop target". According to the modification, the alternate "start target" hangs straight down from the game before play begins and the attached eccentric cam is adjusted in such a way that it toggles the adjacent alternate momentary switch whenever the alternate "start target" pivots backward upon being struck. When struck a first time, the alternate "start target" starts the stop watch, to which the alternate momentary switch is electrically connected. When struck a second time, the alternate "start target" also stops the stop watch, thus eliminating the need for a separate "stop target" to stop the stop watch.

DETAILED DESCRIPTION OF THE PREFERRED EMBODIMENTS

Figure 1:
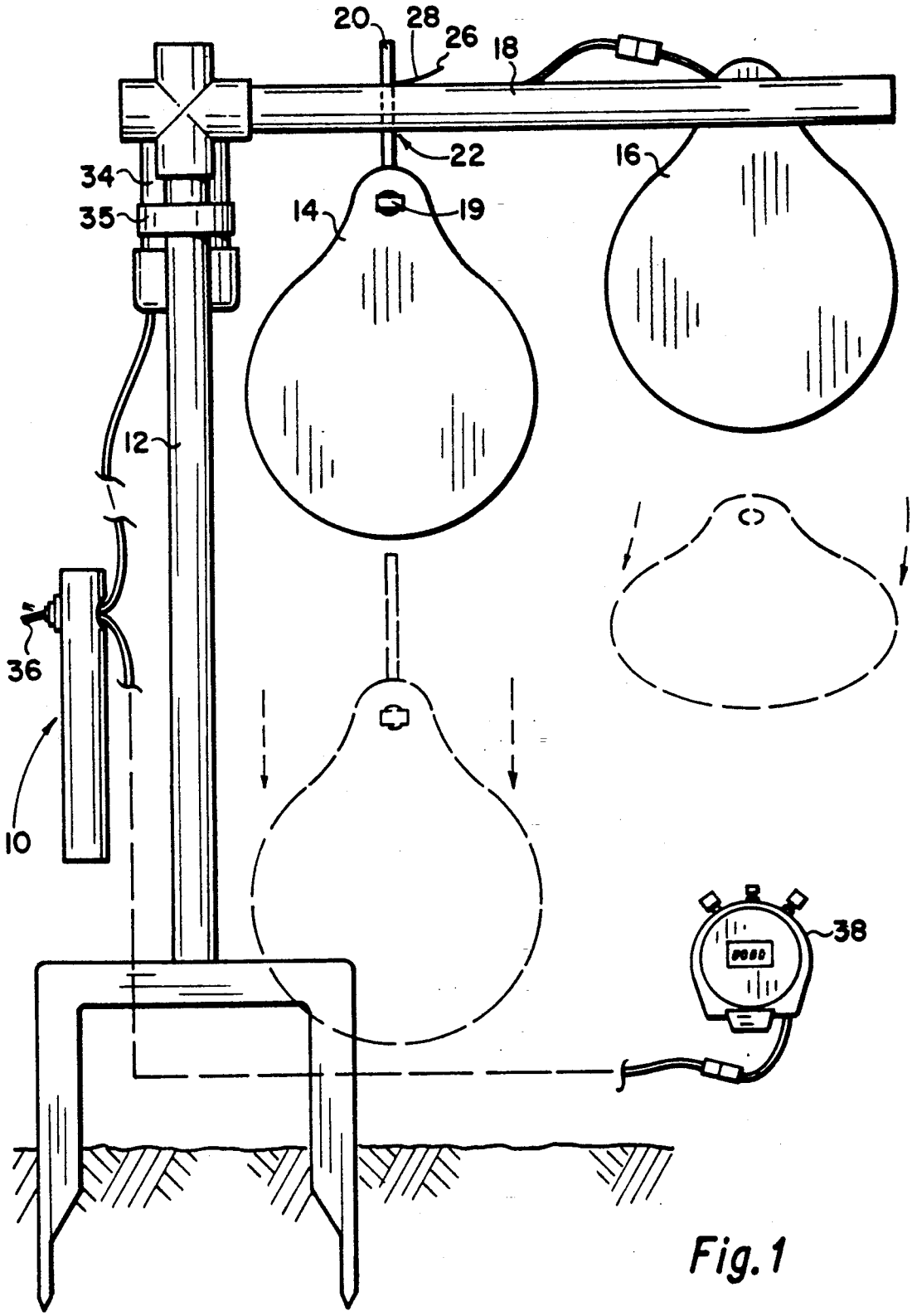
FIG. 1 is a partial front elevation of a pop target game employing a preferred embodiment of the present invention as a means of starting and stopping the game.
Figure 3:
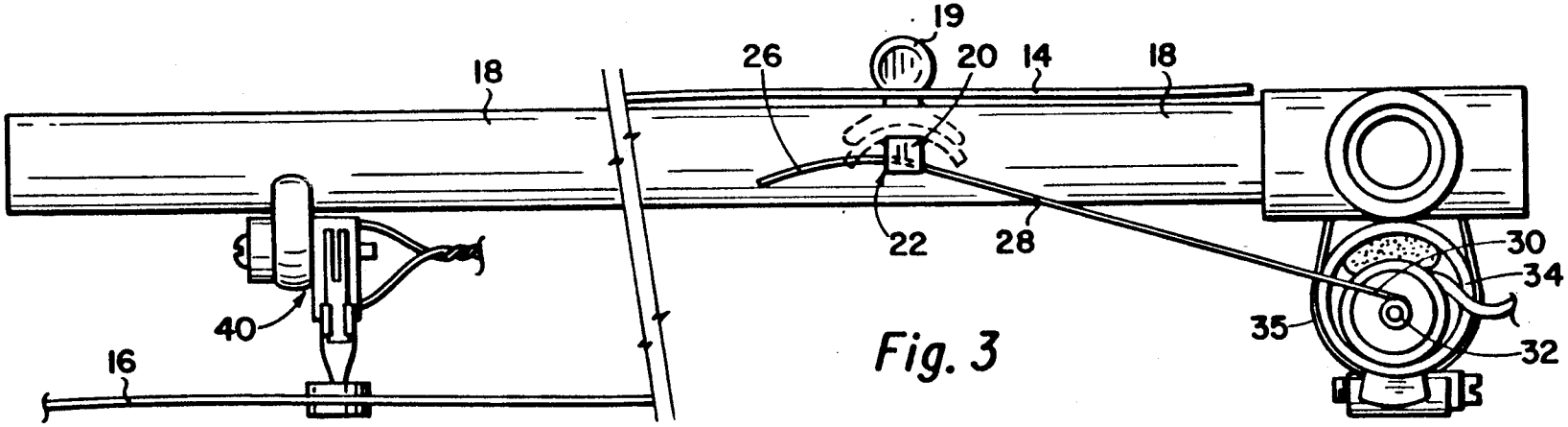
FIG. 3 is a partial top plan view of the present invention taken along line 3—3 of the FIG. 2.
Figure 2:
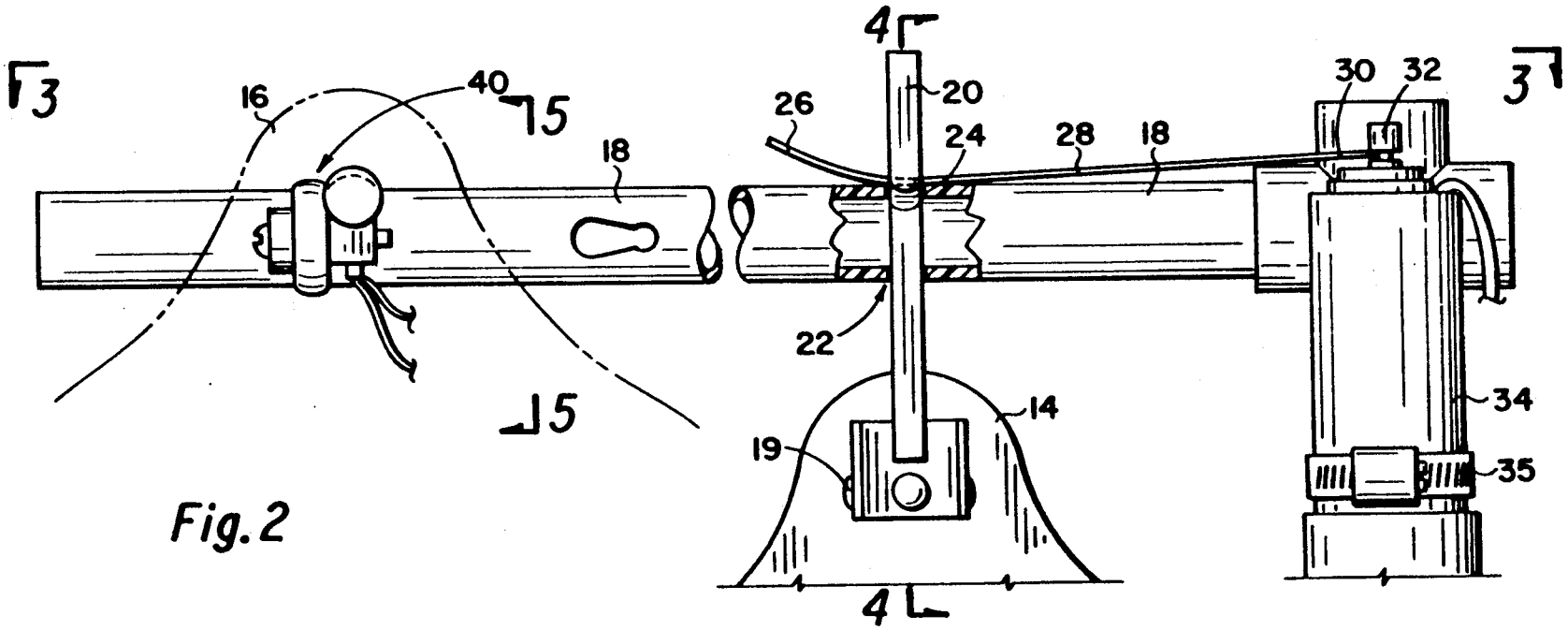
FIG. 2 is a partial rear plan view of the present invention.
Figure 5:
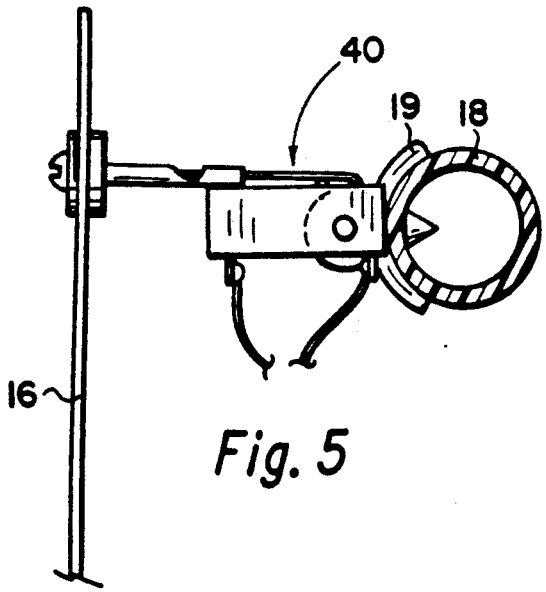
FIG. 5 is a partial cross-sectional view of the present invention taken along line 5—5 of FIG. 2, showing the micro switch in a closed position.
Figure 6:
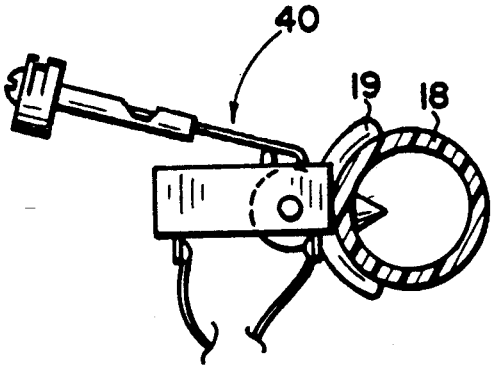
FIG. 6 is a view similar to FIG. 5 showing the micro switch in an open position.
Figure 4:
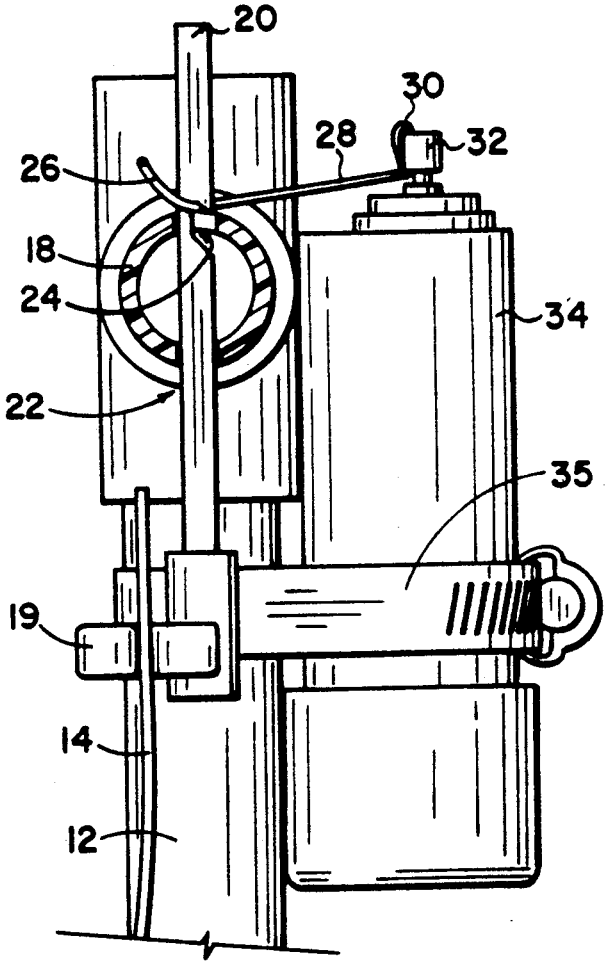
FIG. 4 is a partial cross-sectional view of the present invention taken along line 4—4 of FIG. 2.

Referring now to the drawings and initially to FIG. 1, there is illustrated the present invention, a feature, generally designed by reference number 10, for starting and stopping a timed game, such as a pop target game 12.

In playing with a pop target game 12, only one contestant (not shown) plays at a time. Play begins at the drop of a "start target" 14. The "start target" 14 may be colored green to visually indicate that it functions to start the game. When the "start target" 14 drops, the contestant (not shown) uses projectiles (not shown), such as rubber bands, balls, etc. to knock off any remaining targets (not shown) from the game 12, reserving a "stop target" 16 as the last one to be knocked off. Play ends when the "stop target" 16 falls from the game 12. The "stop target" 16 may be colored red, if desired, to visually indicate that it functions to stop the game.

The "start target" 14 attaches by means of a fastener 19 to a bar 20 which extends upward from the "start target" 14. Although the present invention is not limited to any particular type of fastener, fastener 19 may be of a type disclosed in patent application Ser. No. 07/835,367 filed on Feb. 14, 1992 for a "Fastener For Holding An Object Against The Side Of A Pipe" by the inventor of the present invention.

The bar 20 extends upward through a hole 22 provided in the horizontal rod 18. A notch 24 is provided in the bar 20 at a point where the bar 20 extends above the horizontal rod 18. A first end 26 of a cable 28 inserts into the notch 24 to secure the bar 20 within the hole 22 and thus secure the "start target" 14 to the horizontal rod 18. A second end 30 of the cable 28 connects to a motor shaft 32 around which the cable 28 is wound when a motor 34 which is attached to the motor shaft 32 is activated. Said motor 34 is attached to the game 12 by means of a clamp 35 or other suitable means.

A momentary switch 36 which is electrically connected to the motor 34 can be toggled to activate the motor 34. When the motor 34 is activated the cable 28 winds around the motor shaft 32 pulling the first end 26 out of the notch 24 and thus allowing the bar 20 and the attached "start target" 14 to fall. Simultaneously with activation of the motor 34, toggling the momentary switch 36 starts a stop watch 38 to which the momentary switch 36 is also electrically connected. The stop watch 38 serves to record the time required to complete the game, i.e a playing time.

The "stop target" 16 attaches to the horizontal rod 18 by means of a micro switch 40 on which the "stop target" 16 hangs. The micro switch 40 is attached to the horizontal rod 18 by means of a fastener 19 or by other suitable means. The micro switch 40 connects electrically to the stop watch 38 as a means of stopping the stop watch 38. Once the stop watch 38 has been started, i.e. by toggling the momentary switch 36, the stop watch 38 continues to run as long as the "stop target" 16 rests on the micro switch 40. As soon as the "stop target" 16 is knocked off of the micro switch 40, the micro switch 40 opens, thus stopping the stop watch 38. The halted stop watch 38 indicates the time required by the contestant (not shown) to complete the game, i.e. the playing time.

Figure 7:
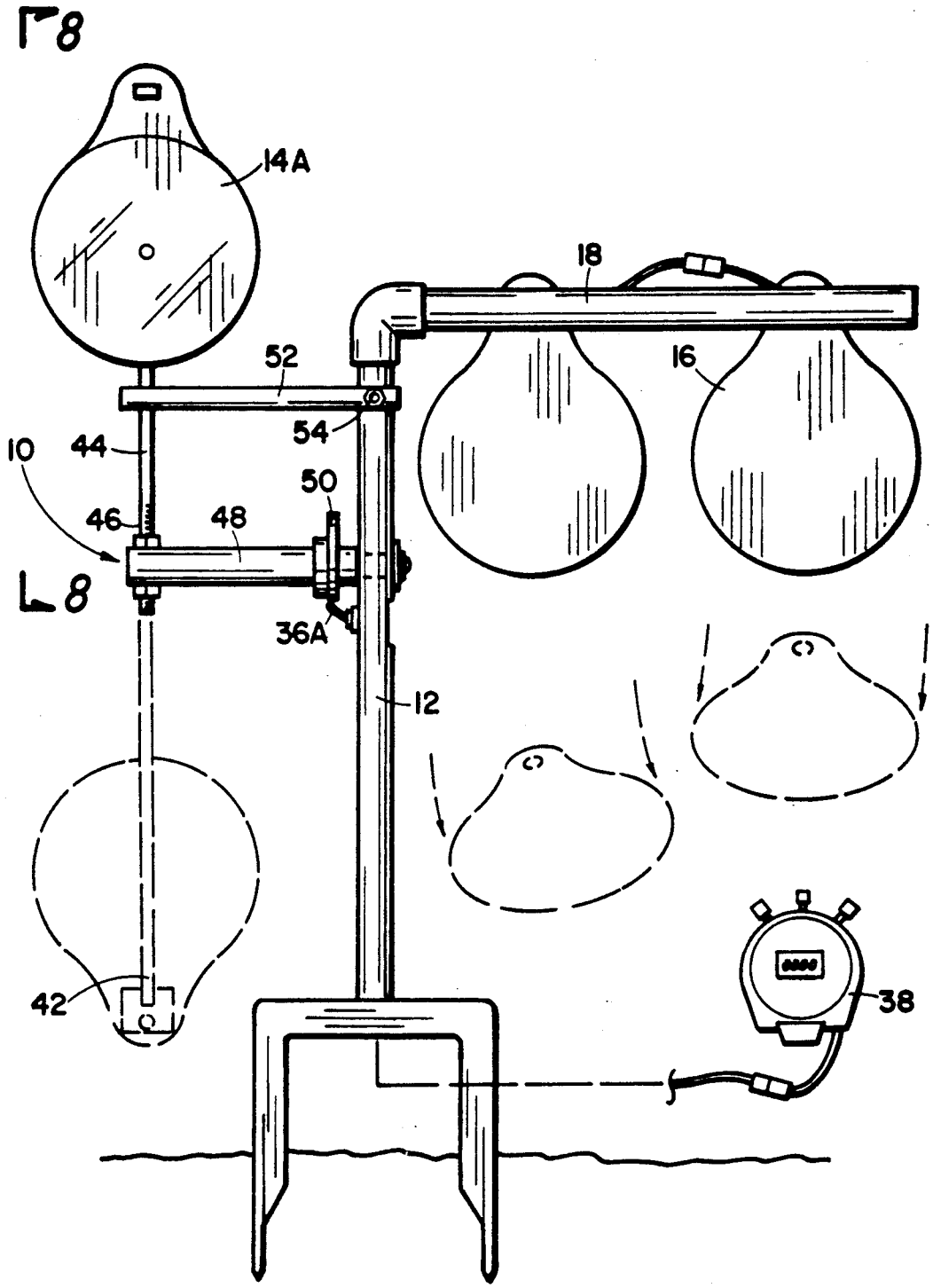
FIG. 7 is a partial front elevation of a pop target game employing an alternate embodiment of the present invention as a means of starting and stopping the game.
Figure 8:
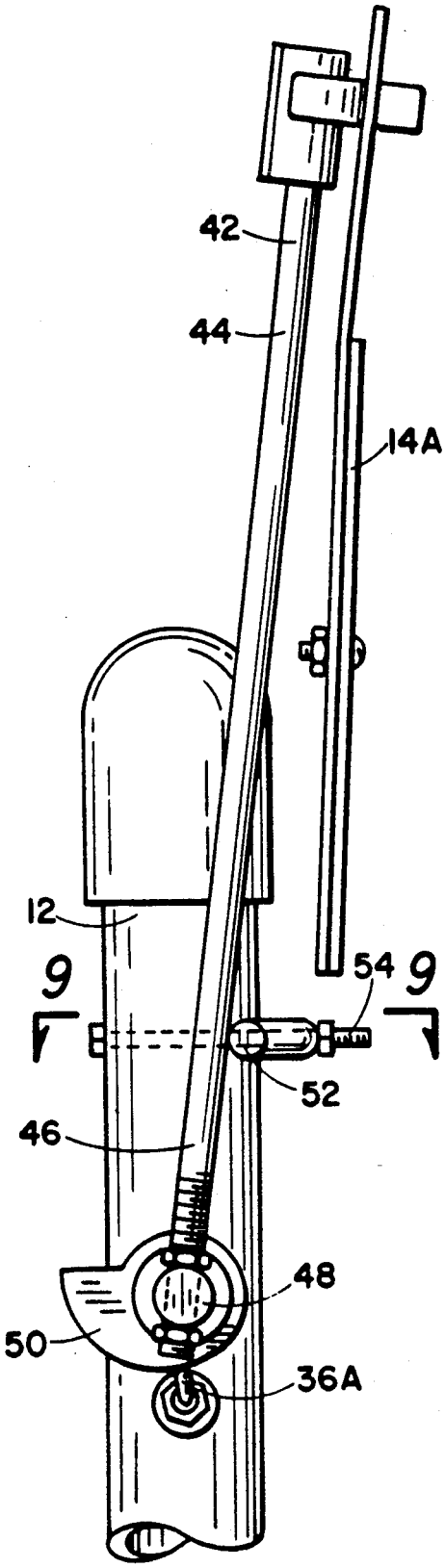
FIG. 8 is a partial, right side elevation taken along line 8—8 of FIG. 7.
Figure 9:
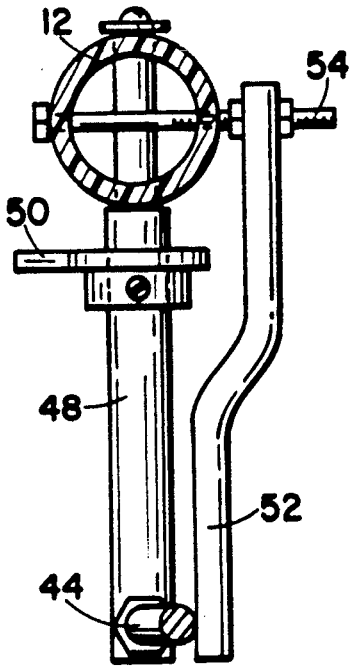
FIG. 9 is a cross-sectional view taken along line 9—9 of FIG. 8.
Figure 10:
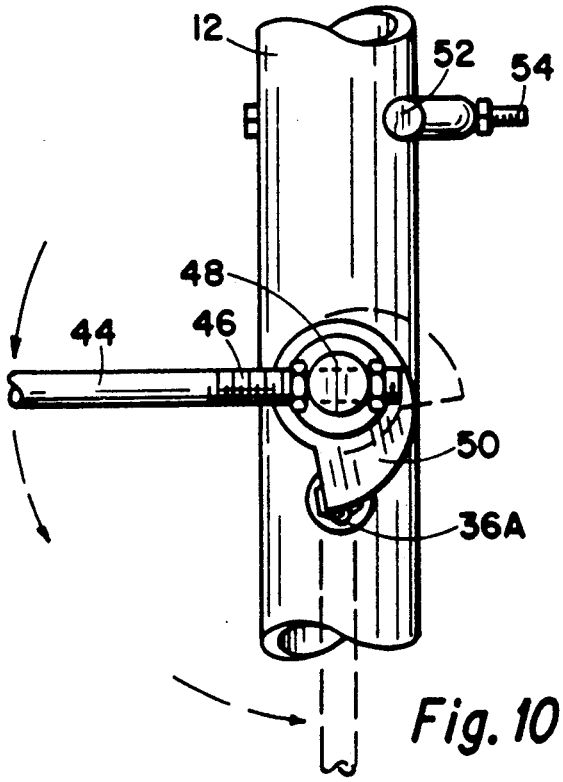
FIG. 10 is a partial right side elevation, similar to FIG. 8, showing how the arm and cam pivot when the "start target" is struck.

Referring now to FIG. 7, there is illustrated an alternate embodiment of the feature 10. This alternate embodiment employs a different means for initiating play, but utilizes the same means for terminating play as the previously described first embodiment. The alternate embodiment has an alternate "start target" 14A which is attached to a target end 42 of an arm 44. A pivotal end 46 is provided on the arm 44 opposite the target end 42. The pivotal end 46 pivotally mounts on the game 12 by means of a horizontal pivot rod 48. An eccentric cam 50 attaches to the arm 44 by means of the horizontal pivotal rod 48 so that the eccentric cam 50 turns whenever the arm 44 pivots.

The eccentric cam 50 lies adjacent to an alternate momentary switch 36A so that when the eccentric cam 50 turns, the alternate momentary switch 36A is toggled. Toggling of the alternate momentary switch 36A starts the stop watch 38 to which the alternate momentary switch 36A is electrically connected.

At the beginning of play, the arm 44 rests against a horizontal support 52 which is attached to the game 12 by means of a bolt 54 or other suitable means. Play begins when a contestant (not shown) strikes the alternate "start target" 14A, causing it to fall backward and causing the arm 44 to pivot and the horizontal pivot rod 48 to turn. Turning of the horizontal pivot rod 48 causes the eccentric cam 50 to turn, and turning the eccentric cam 50 toggles the alternate momentary switch 36A, thus activating the stop watch 38. Once the stop watch 38 has been started, it continues to run as long as the "stop target" 16 rests on the micro switch 40. Stopping the stop watch 38 by knocking the "stop target" 16 off of the micro switch 40 is the same as previously described above for the first embodiment. The stop watch 38, as previously described for the first embodiment, serves to record the playing time.

A modification (not shown) of the second embodiment can be made which has the alternate "start target" 14A hanging straight down from the game 12 before play begins. The eccentric cam 50 is adjusted in such a way that it toggles the alternate momentary switch 36A whenever the alternate "start target" 14A is struck a first time with sufficient force to cause it to pivot in a swinging movement backward and upward from its original position, such as a strike from an arrow (not shown) or other similar device. Toggling the alternate momentary switch 36A activates the stop watch 38 to which the alternate momentary switch 36A is electrically connected.

This modification of the second embodiment is employed with a means for stopping the stop watch 38 which consists of either the "stop target" 16 as previously described or utilizing the alternate "start target" 14A as a means for stopping the stop watch 38. When the alternate "start target" 14A is employed as the means for stopping the stop watch 38, the stop watch 38 is stopped by the alternate "start target" 14A being struck a second time with sufficient force to cause it pivot in a swinging movement backward and upward from its original position. When the alternate "start target" 14A pivots, it causes the eccentric cam 50 to toggle the alternate momentary switch 36A which in turn stops the stop watch 38 to which the alternate momentary switch 36A is electrically connected.

The first embodiment, i.e. the embodiment with the "start target" 14, the motor 34 and the momentary switch 36, is used when play is to be started by a non-contestant. The alternate embodiment, i.e. the one employing the alternate "start target" 14A, the arm 44, the horizontal pivot rod 48, the eccentric cam 50, the alternate momentary switch 36A and the horizontal support 52, is used when the contestant (not shown) desires to self-initiate play.

Whereas, the present invention has been described in particular relation to the drawings attached hereto, it should be understood that other and further modifications, apart from those shown or suggested herein, may be made within the spirit and scope of this invention.

What is claimed is:

1. A feature for stopping, starting and recording the elapsed playing time for a timed game, comprising:

a start target removably attached to the game, a stop watch, means for simultaneously causing the start target to fall and electrically starting the stop watch, a motor, a momentary switch electrically connected to the stop watch and electrically connected to the motor so as to simultaneously start the stop watch and activate the motor, means whereby activating the motor causes the start target to fall, and means for electrically stopping the stop watch when play ends.

2. A feature for stopping, starting and recording the elapsed playing time for a timed game, comprising:

a start target removably attached to the game, a stop watch, means for simultaneously causing the start target to fall and electrically starting the stop watch, a micro switch, a stop target being removably attached to the game by means of the micro switch, said micro switch being closed when the stop target is attached and being open when the stop target is removed, said micro switch being electrically connected to the stop watch so as to stop the stop watch when the micro switch is open.

* * * * *